US005137760A

United States Patent [19]

Lundquist

[11] Patent Number: 5,137,760

[45] Date of Patent: Aug. 11, 1992

[54] DEACIDIFICATION PROCESS

[75] Inventor: Eric G. Lundquist, Hillsborough, Calif.

[73] Assignee: Document Reprocessors, San Francisco, Calif.

[21] Appl. No.: 696,594

[22] Filed: May 7, 1991

Related U.S. Application Data

[63] Continuation of Ser. No. 335,366, Apr. 10, 1989, abandoned.

[51] Int. Cl.[5] ..... B05D 1/18

[52] U.S. Cl. ..... 427/439; 422/40; 427/296; 427/377

[58] Field of Search ..... 427/296, 439, 377; 422/40

[56] References Cited

U.S. PATENT DOCUMENTS 3,676,182 7/1972 Smith ..... 427/421 X
4,318,963 3/1982 Smith ..... 427/296 X

*Primary Examiner*—Michael Lusignan
*Attorney, Agent, or Firm*—Shoemaker and Mattare, Ltd.

[57] ABSTRACT

This invention relates to a process for treating a printed cellulosic article for inhibiting acid promoted deterioration thereof comprising providing in a pressure vessel containing said article, a transport medium containing carbon dioxide, and base material dispersed in said medium for transport to said article said vessel being pressurized with said carbon dioxide to between about 650 and about 1200 psi and maintained for a sufficient treatment period to cause substantial pervasion of said base material in said article, and separating said medium from said article.

15 Claims, No Drawings

DEACIDIFICATION PROCESS

This is a continuation of application Ser. No. 07/335,366, filed Apr. 10, 1989, now abandoned.

DEACIDIFICATION PROCESS

This invention concerns the deacidification of paper products and in particular paper products which tend to undergo gradual deterioration due to the influence of acidic materials which may be residual from the processes of paper making or derived, for example, from the atmosphere. Such paper articles include books particularly older library books and other paper products made primarily of cellulosic material.

Much of the paper employed in books is or was prepared by a variety of processes, nearly all of which employ chemicals which can provide the production over extended periods of time of acidic anions, particularly sulfate ions $SO_4=$ in amounts in the paper which are deleterious to the cellulosic paper structure. Acidic materials which are present in the atmosphere, or which may be present from the paper making process or in various additives or processing aids in paper making, or which are present in cellulosic material naturally such as the acidic phenolic units of lignin, also contribute to the paper acidity and its eventual deterioration. The circumstance of this acidic deterioration is of course widely known in paper making technology and are particularly troublesome to archives and libraries and to those collectors or museums who store valuable literary or other works which can be subject to the problem of deterioration. Many accountings of the acid catalyzed or promoted destruction of the cellulose or $\beta$-cellulose moities, and various chemical processes for deacidifying books and the like are found in the literature such as the U.S. patents identified hereinafter.

It is known in the art of deacidification that various basic materials may be deposited as fine particles from various organic solvent systems. Such procedures are described, for example, in U.S. Pat. Nos. 3,676,182; 4,318,963; and 3,939,091, the disclosures of which are incorporated herein by reference. Also known from such patents is the formation in situ, or the direct use, of the carbonate or bicarbonate salts, e.g., of magnesium or organic-Mg compounds such as lower alkoxides, which salts, upon hydrolysis and ionization occurring over long periods of time in the often minuscule amounts of water present in the paper will provide neutralizing hydroxyl ions in sufficient quantity to potentially inhibit acid promoted deterioration.

Such deacidification chemistry however, is much easier to comprehend than to apply in any practical and effective manner to tightly bound volumes of any substantial thickness. In this regard, the processes exemplified in such patents as cited above may be effective for single sheets or even books so long as they are loosely bound or the pages are clearly exposed to the treating solution. Unfortunately, it has become necessary to deacidify a great number of large books or volumes wherein the pages cannot be readily presented to the treating solution, for example, where the books are essentially stacked in large numbers in the treatment apparatus.

Inherent in these processes also are problems such as chemical attack by the process chemicals used. For example, it is possible for there to be solvent leaching of inks or the like, solvation of binding glues, or deterioration of the binding materials used. This is particularly acute where alcohol containing solvents are employed. It is likewise a problem to rid the books or other articles of odiferous solvents, giving the collection of treated books an objectionable odor. These problems are especially prevalent where solvents such as petroleum distillates or more exotic organic materials are employed in essentially undiluted form. Further, it is also a problem where solvents which have relatively low volatilities are used as they tend to leave substantial residue films on the pages.

The present invention has as its objects therefore: to provide a process for deacidifying books and the like wherein the basic treating materials penetrate even tightly closed volumes; to further provide process whereby solvent odor and residue are substantially reduced or avoided; to still further provide a process which can be carried out in a relatively inexpensive manner with relatively inexpensive equipment and materials; and to provide a process which can accommodate simultaneously a large number of books while still providing an effective distribution of base or basic or acid neutralizing materials throughout their pages.

The foregoing and still further objects have been, and can be attained, in accordance with the present invention which is defined in its broad sense as a process for treating a printed cellulosic article for inhibiting acid promoted deterioration thereof, comprising in one embodiment the steps of providing in a closed vessel containing said article, a transport medium containing carbon dioxide, and a basic or acid neutralizing material dispersed in said medium to be transported to said article, said vessel being in one embodiment pressurized with said carbon dioxide at a pressure of from between about 400 and about 1200 psi, such that at least some of the carbon dioxide is either in the liquid state or dissolved in the transport medium, and maintaining said vessel at said pressure for a sufficient period of time so that the article is substantially pervaded with said basic or acid neutralizing material. The pressure is then reduced and the medium separated from said article in a manner that permits the deposition of said basic or acid neutralizing material in said article.

In certain preferred embodiments of the present invention: the following conditions are maintained to achieve the advantages described herein.

The temperature of said medium is maintained below about 31.0° C. and the pressure is maintained below about 1,100 psi.

The basic material employed can be selected form inorganic and organic salts, oxides, alkoxides or hydroxides of magnesium, alkaline earth metals or alkali metals, or mixtures or complexes thereof.

A cosolvent can be admixed with said carbon dioxide in a liquid volumetric ratio of $CO_2$/cosolvent of from about 20/1 to about 1/3;

In practice, using the above conditions, the base material is converted in situ to a carbonate which, in an aqueous system, gives a basic pH; and Preferably said vessel and article are flushed during or after said treatment period with fresh carbon dioxide not containing the neutralizing compounds.

Further preferred materials, components and techniques are set forth hereinafter and in the claims appended hereto.

In the operation of this process the article such as books, pamphlets, newspapers, magazines, technical or historical documents, or the like are first placed in a pressure vessel of any convenient size, varying, for example from two liters up to several hundred liters. The article is preferably supported within the vessel such that at least most of its surface portions will be exposed. The carbon dioxide of the transport medium may be fed to the vessel as a gas and pressurized therein to operating pressure as a liquid depending upon the temperature and pressures employed. For example, the temperature may be maintained fairly close to the critical temperature of $CO_2$, i.e., 31.1° C., and at pressures such as 650–900 psi, at which the medium will likely be in the form of a liquid/gas type bi-phase dispersion. For most applications, the near critical operating mode is preferred for a wide variety of reasons. Where $CO_2$ is the only component of the transport medium, it is preferable to admix the base material with the $CO_2$ liquid as it is being fed to the vessel, however, the admixing may be done beforehand or even within the vessel by any suitable mixing technique. For example, the base material whether it be solid particulate or liquid may be first loaded into the vessel and the $CO_2$ feed gas or liquid passed therethrough at a sufficient rate and agitation to disperse the base material in the $CO_2$ for proper transport to the article and penetration and/or diffusion thereinto.

The present invention utilizes any of a great variety of base or neutralizing compositions or base forming materials, all hereinafter being referred to as base or basic materials, including but by no means limited to metal hydroxides, oxides, alkoxides, and organic carboxylates, carbonates or chelates. The useful organic moities of such materials are essentially limitless in variety. Especially useful organic compounds, for example, are those of the formulae $(R—c—o)_n M$, $(R—o—c—o)_n M$ and $(R—O)_n M$, wherein R is alkyl group of 1–20 carbons, preferably 1–6 carbons, or R is an ether group of the formula $R\ (OR)_n$, wherein R is hydrocarbon of 1–6 carbons, n is the valence of M, and n is 1–100, preferably 2–40, and most preferably 3–20. The selection of the base material is made, for example, on its solubility or dispersibility in $CO_2$ or in desirable cosolvents, and on its capacity to deliver the base metal in an oxidized state for easy conversion to the hydroxide or to a buffer material such as a carbonate which upon hydrolysis yield net hydroxyl ions in the paper.

As indicated above, the $CO_2$ may be used with other transport materials, termed herein as cosolvents, whether they function in all instances to solvate or not, but which can assist by solvation or otherwise to disperse the base material in the transport medium. The cosolvents are, for example, normally liquid hydrocarbons such as hexane, halogenated hydrocarbons such as the Freon type materials typified by dichlorodifluoromethane, alcohols such as methanol, and other more complex organic materials such as hydroxymethylcellulose. The cosolvents are preferably used in minor quantities and preferably are selected to have substantial volatilities and little odor such that their residues in the paper are minimized and inoffensive. It is particularly noted that whether these cosolvents actually solvate the base material and form a solution thereof, or merely assist in some manner to disperse the base material in the transport medium, the high pressure ubiquitous $CO_2$ presents an irresistible driving force for transporting or penetrating the base material as solution or particles into the bound volumes or other articles.

It is preferred that the cosolvent be soluble or miscible with $CO_2$ such that a more homogeneous system can be achieved, and also such that flushing of the vessel with $CO_2$ after initial removal of the original transport medium will remove residual cosolvent from the article and further minimize objectionable solvent odor and residue. In this regard, in one embodiment of the present invention, a double cell apparatus is employed wherein the transport medium is expanded with $CO_2$ to the working composition in a lower cell and is drawn into a upper cell at uniform composition until the pressure of the $CO_2$ is changed. This arrangement also allows the medium to be returned to the lower cell and the books in the upper cell to be flushed with $CO_2$ to remove the solvent before the cell is opened. Such an arrangement is particularly desirable where recovery of the medium components is important.

The following deacidification examples or runs will further illustrate practice of the present invention. Employed in these examples was a cylindrical steel pressure cell or vessel of about 3.25 inch diameter, about 21 inches deep, and sealed with a steel lid secured by a threaded and bolted cap bearing on the lid. The working volume of this cell was approximately 2600cc and for each run, methyl magnesium oxide (MMO) in approximately one liter of cosolvent was employed, of the following composition:

| | |
|---|---|
| 90 | ml. MMO concentrate - 10% Mg in MeOH; |
| 60 | ml. MeOH alcohol; |
| 850 | ml. Freon 113; |
| 938 | ml. of solvent containing 1% Mg calculated as the metal. |

In order to fit the cell, the books had to pass through a 3" circle. Normal-sized books were cut on a paper cutting guillotine to approximately three inches wide and three inches in height. The books were of two types: old books discarded by the Killam library and recently-published Harlequin paperbacks published by Harlequin Enterprises Ltd., Toronto ONT. In 1985. The reject books were usually discarded because the bindings and paper had deteriorated to the point that the cost of repair was considered to be greater than the value of the book. They were printed on average about the year 1900. The paper showed a strong acidic reaction when tested with chlorophenol red indicator. The bindings of the Harlequin books were adhesive applied to single sheets, so-called "perfect" binding. The covers were printed in bright colours and covered with a sheet of laminated plastic. The older books showed conventional sewn and animal glue construction, one book had half-leather binding, one had glazed paper and most had library classification labels attached to the spine. In Table 1, "New" refers to the Harlequin paperbacks and "Old" to those from the Killam Library. To support the books in the cell, two eight-inch pipe nipples (¾) were placed in the cell to provide a platform above the initial liquid cosolvent level on which the books were placed.

It had previously been determined, using smaller cell with glass sight windows that the volume would expand to about 2000 ml at 700 psi of carbon dioxide and that at 750 psi and a volume of 2300 ml, a cloud of methylmagnesium carbonate (MMC) would form.

In a typical run, the books were placed on the platform in the cell just above the cosolvent system therein, the cell closed and the $CO_2$ run in at the bottom of the cell to the pressure required. In the first run shown below, for example, a pressure of 700 psi was held for 30 seconds, the pressure then increased to 900 psi to form a cloud, this pressure then held for 10 seconds and a valve at the top of the cell then opened to slowly reduce the pressure. The time taken to reduce the pressure from 900 psi varied from 8 minutes to 2 minutes in the various runs. At room pressure, the volume of solvent returned to a value slightly less than the original, due to losses in the books and in the escaping $CO_2$ gas. On opening the cell, the books were found to be wet with solvent but they dried off rapidly. The books were separated into two halves, pages from the front, middle and back were removed and the ink marks examined. The removed pages were sprayed with indicator and photographed in colour to record the penetration of the neutralizing solution.

Eight experimental runs were thusly made in the cell and the results are tabulated in the following table.

TABLE I

| Run # | Solution | Books | Time/pressure | Results |
|---|---|---|---|---|
| 1 | 90 ml. MMO<br>60 ml. CH3OH<br>850 ml. 113 | Dry<br>#20<br>#7 | 700 psi-30 sec.<br>900 psi-10 sec.<br>let down 8 min. | New-partly wet<br>alk in half<br>Old alk wetted |
| 2 | same as 1<br>book support<br>lowered | Not<br>dry<br>#21<br>#4 | 700 psi-8 min.<br><br><br>let down 8 min. | New-alkaline<br>Old-patchy |
| 3 | same as<br>1 & 2 | Dry<br>#23<br>#4 | 900 psi-8 min.<br><br>slow let down | New-alkaline<br>Old-patchy<br>clouded? |
| 4 | Fresh sol.<br>as in run 1 | Not<br>dried<br>#34<br>#8 | 700 psi-18 min.<br><br>900 psi-1 min.<br>slow let down | New-alkaline<br>Old-poor<br>penetration |
| 5 | As in run 4 | Dry<br>#22 | 700 psi-8 min.<br>900 psi-1 min.<br>let down 5 min. | New-alkaline<br>Old-poor<br>penetration |
| 6 | As in run 4 | Not<br>dried<br>#13 | 700 psi-8 min.<br><br>900 psi-1 min.<br>let down 4 min. | New-alkaline<br>Old-patchy<br>in center |
| 7 | As in run 4 | Not<br>dried<br>#12<br>#33 | 700 psi-16 min.<br><br>900 psi-1 min.<br>let down 2 min. | Severe damage<br>to laminate<br>cover & labels |
| 8 | HMC-200 cc<br>Fr. 113 600 cc | Dry<br>#24<br>#6 | 550 psi-8 min.<br>750 psi-2 min.<br>let down 2 min. | New-alkaline<br>Old-good<br>penetration |

It is evident that the solution leaches adhesives and coloured inks from the paper and especially from the coloured printing on the cover of the Harlequins. The solution took on a dirty brown colour which transferred to the pages of the books. If the books had been flushed with $CO_2$ while still in the cell, they would have come out drier and probably much of the discolouration of the pages would have been avoided.

As there were only about three liters of Freon 113 available, the solution was reused for several runs. This made comparison of results difficult, especially on such questions as the effect of drying the books to remove moisture. Solutions used with normal books having about 8% water, may have picked up much of this water possibly making the solvent action more aggressive. The books were restrained with elastic bands to simulate closely packed books. Penetration was a problem, and for this reason in later runs the times and pressures were increased to effect better penetration. As the treatment time increased, however, the leaching increased. At 16 minutes treatment at 700 psi and 6 minutes at 900 psi severe effects on the lamination of the covers, the coloured inks and spine labels resulted. This suggested that a treatment time of about 8 minutes with this solvent mix and this temperature was the maximum that could be tolerated. It is likely that fast let down of pressure increases the probability of delamination.

The best results were reported for run 8 which contained, in addition to MMC, carboxy methyl cellulose which had been modified to make it more soluble in methanol. In this run, a pressure of 550psi was held for 8 minutes, followed by 900 psi for 2 minutes. The penetration and buffer content showed the best results of any of the eight runs. This run used fresh transport medium and dried books.

In practicing the present invention according to one particularly innovative and effective technique, the base material, e.g., methyl magnesium oxide (MMO) in methanol and Freon or other solvent therefor, is converted to methyl magnesium carbonate (MMC) in the pressure cell. As the pressure therein is increased to about 750 psi, MMC tends to be released from the liquid body and form a cloud above the liquid. In instances where actual contact of the article with the concentrated liquid transport medium is preferably to be avoided, the article can be so placed in the cell as to be contacted substantially only by the MMC cloud.

As previously described the most preferred embodiments of the present invention utilize organometallic dialkoxides of magnesium which are capable of being solubilized in the selected transport medium and are converted to the carbonate or oxide or hydroxide in situ in the cellulosic web of the book or other article. Exemplary values obtained indicating deacidification potential for such materials showed improvements ranging from an original pH of 4.5 going to 8.3 in predried books and 8.5 in off-the-shelf books. The strength of the paper in a known test for fold breakage rose typically from a value of about 3 for untreated paper to between 21 to 33 for treated paper.

The following Table shows a summary of results using different transport media at different pressure conditions. The listing of values for $MgCO_3$ is in milligrams of $MgCO_3$ per square cm of paper surface tested in four quadrants of the test piece the upper left being (1) upper right (2) lower left (3) and lower right (4).

TABLE II

| Sample | Description | Composition | $MgCo_3$ Content | Finished pH | Fold Breakage Test |
|---|---|---|---|---|---|
| 1) | Untreated Book | NA | None | 4.5 | 3 |
| 2) | Predried Book | 10% Perchloroethylene $CO_2$ expanded to 65 psi-10 min. | (1) 1.05<br>(2) 1.40<br>(3) 0.91<br>(4) 1.12 | 8.3 | 21 |
| 3) | Ambient Book (off-the-shelf) | 10% PCE or TCE-(perchloroethylene/tetrachloroethylene) $CO_2$ expanded to 650 psi-10 min. | (2) 1.54<br>(3) 1.47 | 8.5 | 7 |
| 4) | Ambient Book | 10% Freon TF | (1) 2.87 | 9.1 | 30 |

TABLE II-continued

| Sample | Description | Composition | $MgCo_3$ Content | Finished pH | Fold Breakage Test |
|---|---|---|---|---|---|
| | (off-the-shelf) | No Pressure-10 min. | (3) 2.83 | | |
| 5) | Untreated Paperback | 100% Freon TF No Pressure 10 min. | None | NA | NA |

In each instance the composition of choice was Magnesium Butoxy triglycolate represented by the general Formula (1):

$$(C_4 H_9 (OCH_2CH_2)_n O)_2 Mg \quad (1)$$

Other alkoxides which are not volatile under the conditions selected and which exhibit the necessary solubility in the transport solvent can of course be employed to advantage.

It can also be seen that the most preferred transport solvent is Freon TF or Freon 113 which is trichlorotrifluoro ethane which has the advantage of being able to be used in apparatus which does not need to be pressurized. In this manner it is possible to employ commercially available equipment currently employed for dry cleaning establishments and the like without excessive or expensive modifications to accomplish the objectives of the present invention.

The invention has been described in detail with particular reference to preferred embodiments thereof, but it will be understood that variations and modifications will be effected within the spirit and scope of the invention.

I claim:

1. The process for treating a printed cellulosic article for inhibiting acid promoted deterioration thereof, comprising providing in a pressure vessel containing said article, a transport medium containing carbon dioxide, and base material dispersed in said medium for transport to said article, said vessel being pressurized with said carbon dioxide to between about 650 and about 1200 psi and maintained for a sufficient treatment period to cause substantial pervasion of said base material in said article, and separating said medium from said article.

2. The process of claim 1 wherein the temperature of said medium is maintained between about 0° C. and about 40° C.

3. The process of claim 2 wherein the temperature of said medium is maintained below about 31.0° C. and the pressure is maintained above about 650 psi.

4. The process of claim 3 wherein the base material is selected from inorganic and organic salts, oxides, alkoxides or hydroxides of magnesium, alkaline earth metals or alkali metals, or mixtures or complexes thereof.

5. The process of claim 1 wherein the concentration of base material cation in said transport medium ranges between about 5.0 and about 0.01% by weight 6. The process of claim 1 wherein cosolvent is admixed with said carbon dioxide in a liquid volumetric ratio of $CO_2$/cosolvent of from about 20/1 to about 1/3.

7. The process of claim 4 wherein the base material is substantially insoluble in liquid carbon dioxide and is dispersed therein by agitation.

8. The process of claim 7 wherein the agitation is effected by turbulent carbon dioxide flow.

9. The process of claim 6 wherein the cosolvent is selected from alcohols, hydrocarbons, halogenated hydrocarbons, or mixture thereof.

10. The process of claim 6 wherein at least one of the cosolvents is halogenated hydrocarbon.

11. The process of claim 3 wherein the base material is converted in situ to a carbonate which, in aqueous system, gives a basic pH.

12. The process of claim 1 wherein said vessel and article are flushed during or after said treatment period with fresh carbon dioxide for further removal of leached, waste, solvent, by-product, or excess base materials from said vessel and said article upon subsequent removal of said purge $CO_2$ from said vessel.

13. The process of claim 1 wherein the pressure vessel is slowly depressurized after said treatment period to separate essentially all of said $CO_2$ from said transport medium.

14. The process of claim 12 wherein the purge $CO_2$ is entered under pressure into the pressure vessel above the liquid level of the transport medium therein, and whereby said medium is forced by said purge $CO_2$ out of the vessel against a lower pressure head.

15. The process of claim 3 wherein said base material comprises one or more compounds of the formulae $M(OR)_n$, $M(OCOR)_n$ or $M(OCOOR)_n$ wherein M is the cation of a metal selected from magnesium, alkaline earth metals or alkali metals, n is the valence of M, R is alkyl of 1-20 carbons, or R is an ether group of the formula $R\ (OR)_n$, wherein R is hydrocarbon of 1-6 carbons and n is 1-100.

* * * * *